US005676078A

United States Patent [19]

Adamski, Jr. et al.

[11] Patent Number: 5,676,078

[45] Date of Patent: Oct. 14, 1997

[54] METHOD AND APPARATUS FOR SEWING SLEEVES ON SHIRT BODIES

[75] Inventors: Maximilian Adamski, Jr.; Stephen J. Pagett, both of Tega Cay, S.C.

[73] Assignee: Union Special Corporation, Huntly, Ill.

[21] Appl. No.: 311,330

[22] Filed: Sep. 23, 1994

[51] Int. Cl.[6] ..... D05B 3/12; D05B 35/10

[52] U.S. Cl. ..... 112/475.03; 112/475.04; 112/475.09; 112/63

[58] Field of Search ..... 112/475.09, 475.07, 112/475.03, 470.07, 470.29, 470.31, 63, 306, 2, 104, 318, 322

[56] References Cited

U.S. PATENT DOCUMENTS

| | | | |
|---|---|---|---|
| 4,159,687 | 7/1979 | Masuda et al. . | |
| 4,467,734 | 8/1984 | Rohr . | |
| 4,467,739 | 8/1984 | Hager et al. . | |
| 4,479,447 | 10/1984 | Rohr . | |
| 4,512,268 | 4/1985 | Rohr . | |
| 4,681,051 | 7/1987 | Kirch et al. . | |
| 4,682,553 | 7/1987 | Bachmann et al. . | |
| 4,744,319 | 5/1988 | Rohr . | |
| 4,823,716 | 4/1989 | Nakashima . | |
| 4,827,856 | 5/1989 | Rohr . | |
| 4,827,858 | 5/1989 | Horie et al. . | |
| 4,836,119 | 6/1989 | Siraco et al. . | |
| 4,998,493 | 3/1991 | Takafumi . | |
| 5,029,541 | 7/1991 | Rohr et al. . | |
| 5,103,749 | 4/1992 | Geisselmann . | |
| 5,188,047 | 2/1993 | Rohr et al. . | |
| 5,251,557 | 10/1993 | Rohr . | |
| 5,370,072 | 12/1994 | Adamski, Jr. | 112/475.03 X |
| 5,383,410 | 1/1995 | Mukai et al. | 112/63 |
| 5,406,900 | 4/1995 | Schramayr et al. | 112/475.09 X |
| 5,419,268 | 5/1995 | Fylen et al. | 112/475.09 X |
| 5,505,149 | 4/1996 | Schramayr et al. | 112/475.09 X |

FOREIGN PATENT DOCUMENTS

| | | |
|---|---|---|
| 62-94195 | 4/1987 | Japan . |

*Primary Examiner*—Peter Nerbun

*Attorney, Agent, or Firm*—Brinks Hofer Gilson & Lione

[57] ABSTRACT

A sewing machine in combination with a work piece control and advancing mechanism and a microprocessor for setting sleeves in shirt bodies. A sleeve and shirt body are manually loaded on the work piece control and advancing mechanism and placed under the presser foot and the individual edge guides. An automatic sew cycle is then actuated that is under the control of the microprocessor. During the automatic sew cycle the sewing machine operator is free to prepare to load the next product.

5 Claims, 9 Drawing Sheets

METHOD AND APPARATUS FOR SEWING SLEEVES ON SHIRT BODIES

CROSS-REFERENCES

The present application is related to U.S. Pat. No. 5,251,557, entitled "SEWING MACHINE WITH AN EDGE GUIDING DEVICE TO GUIDE ONE OR MORE PLIES OF MATERIAL," that issued on Oct. 12, 1993, U.S. Pat. No. 4,512,268, entitled "METHOD AND APPARATUS FOR TENSIONING AND SEWING A TUBULAR WORKPIECE," that issued on Apr. 23, 1985, and U.S. Pat. No. 4,479,447, entitled "METHOD AND APPARATUS FOR SEWING ON A TUBULAR WORKPIECE EDGE," that issued on Oct. 30, 1984. These patents are hereby incorporated by reference in the subject application.

The present application is also related to U.S. Pat. No. 5,370,072, entitled "AUTOMATIC ALIGNMENT OF MATERIAL AND POSITIONING AT THE STITCH FORMING LOCATION," that issued on Dec. 6, 1994. This patent is hereby incorporated by reference in the subject application.

BACKGROUND OF THE INVENTION

This invention relates to a machine and method for automating the sewing step of the process for attaching or setting the sleeves into a shirt body. This invention has been developed for the production of knit T-shirts but can also be used for other outerwear or fleecewear and for certain types of woven garments.

This operation has traditionally been performed manually by a highly skilled sewing machine operator. The repetitive unnatural motions of the operator's fingers, hands and wrist that are required in performing the present manual method places the operator under ergonomic stress and strain. The present manual method is especially stressful on the operator's left hand and arm which must support and guide the work piece, from a location above the work surface. At this elevated location there is no support or rest for the operator's left hand and arm. In the typical commercial construction of a garment of this type 35–40% of the operators assembling the garments are sleeve setters. Because of the high level of skill required to perform the manual sleeve setting operation, sleeve setters require long training periods which adds to the overall cost of producing the garments.

A typical sequence for setting a sleeve using the conventional manual method is as follows:

1. The shirt body and the hemmed and seamed sleeve are individually presented to the operator wrong side out.

2. The operator picks up the shirt body and places the body arm hole alignment point under the raised presser foot of the sewing machine. The operator then signals the presser foot to be lowered to secure the shirt body in place while the operator is preparing to load a sleeve.

3. The operator picks up the sleeve and locates the arm hole seam end point under the presser foot on top of the body arm hole alignment point.

4. The sleeve is pushed through its self and stuffed into the shirt arm hole, right side out, so that when sewn the right sides of the shirt body and sleeve will match.

5. The presser foot is lowered and sewing begins. As the sewing progresses the operator must, with her or his right hand, accurately guide and match both plies into the trim knife of the sewing machine. Simultaneously, with her or his left hand, the operator must hold up the shirt body and sleeve keeping the arm hole open while feeding the bulky shirt body around in a circular fashion. The left hand, arm and elbow must be held above the normal working surface, at a height approximating the arm hole diameter, to accomplish this phase of the operation. Garment arm holes have a diameter of 5 to 12 inches.

6. When the seam is completed, the operator pulls the garment from underneath the presser foot while sewing continues. This produces a chain which must be severed to release the garment. The chain can be severed manually by wiping the garment across a stationary knife blade or by passing it past a mechanically driven knife.

7. The garment is stacked on a collection tray and the process is then repeated.

A typical operator repeats the above process about 1500 times in an 8 hour work day.

In performing this process it is difficult to maintain alignment of both plies of material when feeding to the trim knife. As a result it is necessary to trim a wide ribbon of material to ensure that the seam is closed. Thus waste is high with the conventional manual method.

The conventional manual method is slow, expensive, wasteful of material, has a high rate of unacceptable products and places the operator under ergonomic stress and strain.

For the foregoing reasons, there is a need for a semi-automatic machine and process for setting sleeves into shirt bodies that can be performed by an operator that is not highly trained or skilled, that does not subject the operator to ergonomic stress, is less wasteful of material, produces a greater ratio of acceptable garments and is faster.

SUMMARY OF THE INVENTION

The present invention is directed to a machine and method that satisfies these needs. The apparatus comprises a sewing machine for semi-automatically setting sleeves into a shirt body, that includes a material present sensor, edge guiders, tension rollers and feed pullers. The edge guiders individually control each work piece edge such that the marginal edges of the plies are substantially aligned when they are fed to the trim knife. The mechanism for individually controlling each work piece edge thus functions to insure that the stitch line will be a predetermined distance from the aligned marginal edges of the work pieces prior to edge trimming. This has the advantage that it minimizes the width of the edge ribbon that must be trimmed to assure that the stitch is properly located relative to each individual edge. This greatly reduces the trim waste, saves material cost and improves the quality of the finished garment.

The tension rollers of this invention permit the sleeve to be loaded in a relaxed condition and can be expanded to sew locations which stretches the garment and placed it in a condition that it can be automatically maneuvered and controlled during sewing. The ability to load the sleeve in a relaxed condition and automatically stretch it to the sew condition relieves the operator of the physical task of stretching each sleeve to the sew condition.

The machine of this invention also includes a seam detector that causes the edge controllers to be withdrawn from the stitch line when the beginning of the seam approaches the needle.

The components of the machine and other parameters of the process are controlled by a microprocessor that receives and sends signals to provide for the automatic operation of the entire process. When the sewing machine is running a shaft encoder sends pulses or signals to the microprocessor controller. The shaft encoder sends a series of pulses for every rotation of the sewing machine motor, which is equal to one stitch being produced by the sewing machine. The microprocessor controller then feeds the proper pulses to the edge guiders to keep them in feed or speed synchronization with the sewing speed or feed rate.

After the work pieces have been loaded and the sewing operation initiated, the sewing cycle is under the control of the microprocessor and the operator can direct her or his attention to preparing for setting the other sleeve or for the next garment. This "hands off" automatic sewing cycle eliminates the repetitive tedious use of the operator's hands, fingers and wrists. It also eliminates the need for the operator to hold her or his left arm and hand in a raised unsupported position during the sewing cycle. The productivity of an operator increases because the operator can now prepare to load the next sleeve during the automatic sewing cycle.

In addition to guiding the workpiece edges the microprocessor controller monitors the edge guider sensors to determine if the edges of the material are being controlled. If there are no transitions in signal levels within a certain number of stitch counts during the sewing cycle, the microprocessor controller will stop the operation and send a signal to the operator to resolve the problem.

All of the parameters such as speeds, delay periods, time periods, stitch counts and encoder pulse numbers that go into the timing diagram can be changed and are programmable through the microprocessor control panel. This is a very important feature of this machine since it allows the machine to be used for all sizes and numerous styles of apparel.

BRIEF DESCRIPTION OF THE DRAWINGS

FIG. 10 is a timing diagram for the systems loading and sewing sequences, and.

DETAILED DESCRIPTION OF THE PREFERRED EMBODIMENT

Figure 1:
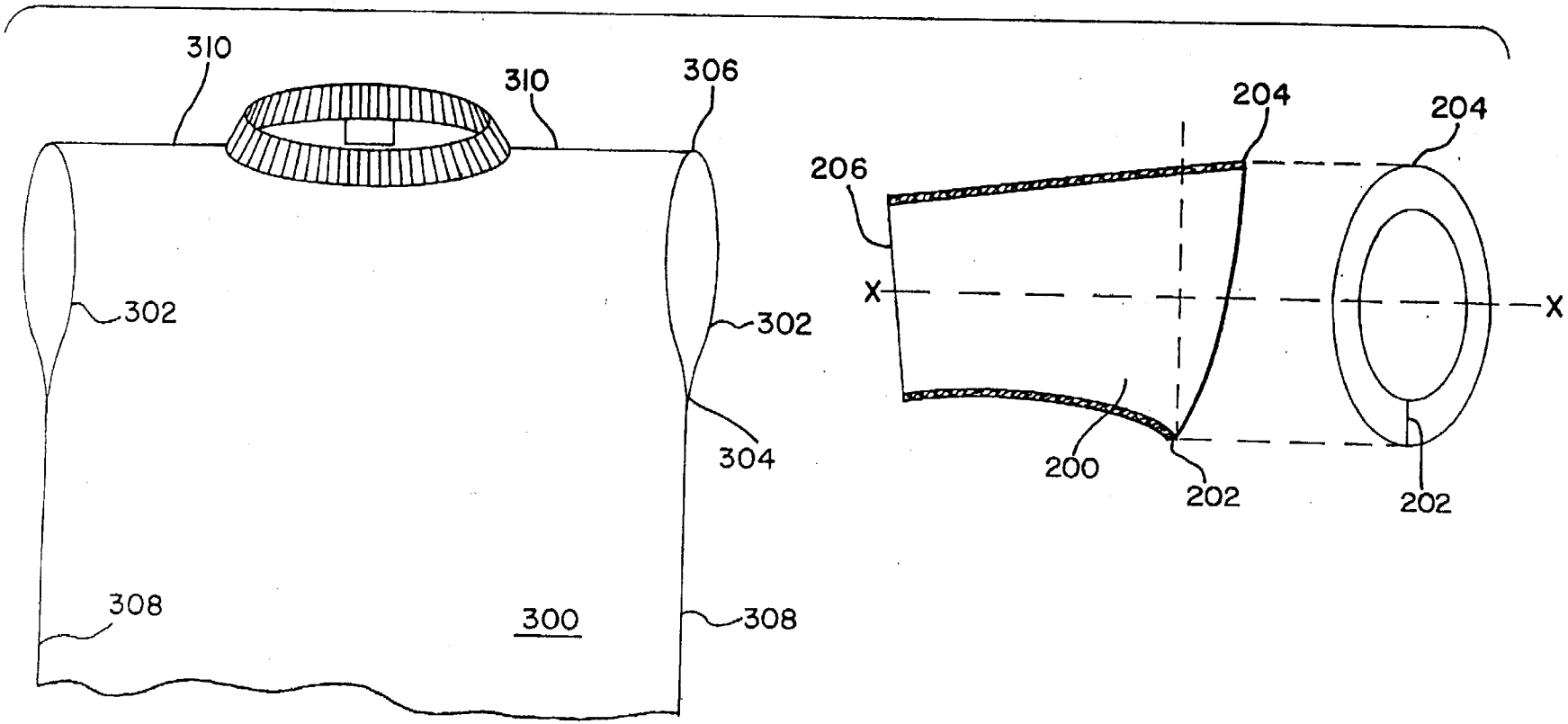
FIG. 1 is a top view of the unsewn shirt body and sleeve.

There is shown in FIGS. 1 a shirt body 300 that is right side out and a sleeve 200 that is wrong side out. The shirt body 300 and sleeve 200 are presented to the operator, to be sewn together, in the condition shown in FIG. 1. The shirt body 300 has an arm hole 302 on each side. The arm holes 302 each have reference points that are refereed to herein as the body arm hole alignment point 304 and a shoulder seam point 306. The body arm hole alignment points 304 are at the intersection of the side seams 308 and the arm holes 302 and the shoulder seam points 306 are at the intersection of the shoulder seams 310 and arm holes 302.

The sleeve 200 has a hemmed end 206 and an arm hole end 204 that is connected to the arm holes 302 of the shirt body 300. Most garment sleeves taper down or smaller along the sleeves longitudinal axis X-X from the arm hole end 204 to the hemmed end 206. It is also the usually pattern for a sleeve that the arm hole end 204 have a generally elliptical shape and the ellipse is tilted relative to the longitudinal axis of the sleeve. Both the taper of the sleeve and the tilt of the elliptical shaped arm hole end 204 greatly complicate automating the sew cycle for setting sleeves. However this invention overcomes these complications by arranging the rollers 72 and 80 such that their free ends converge and providing for an automatic shift to the right of front tensioning roller 72 at a predetermined programmable stitch count during the automatic sewing cycle. The arm hole end 204 of the sleeve 200 has a reference point referred to as the arm hole alignment point 202 or seam end point which must be aligned with the body arm hole alignment point 304 of the shirt body 300.

The term "margin edge" when used in this patent means the edge of the material that extends along the direction of material feed.

Figure 2:
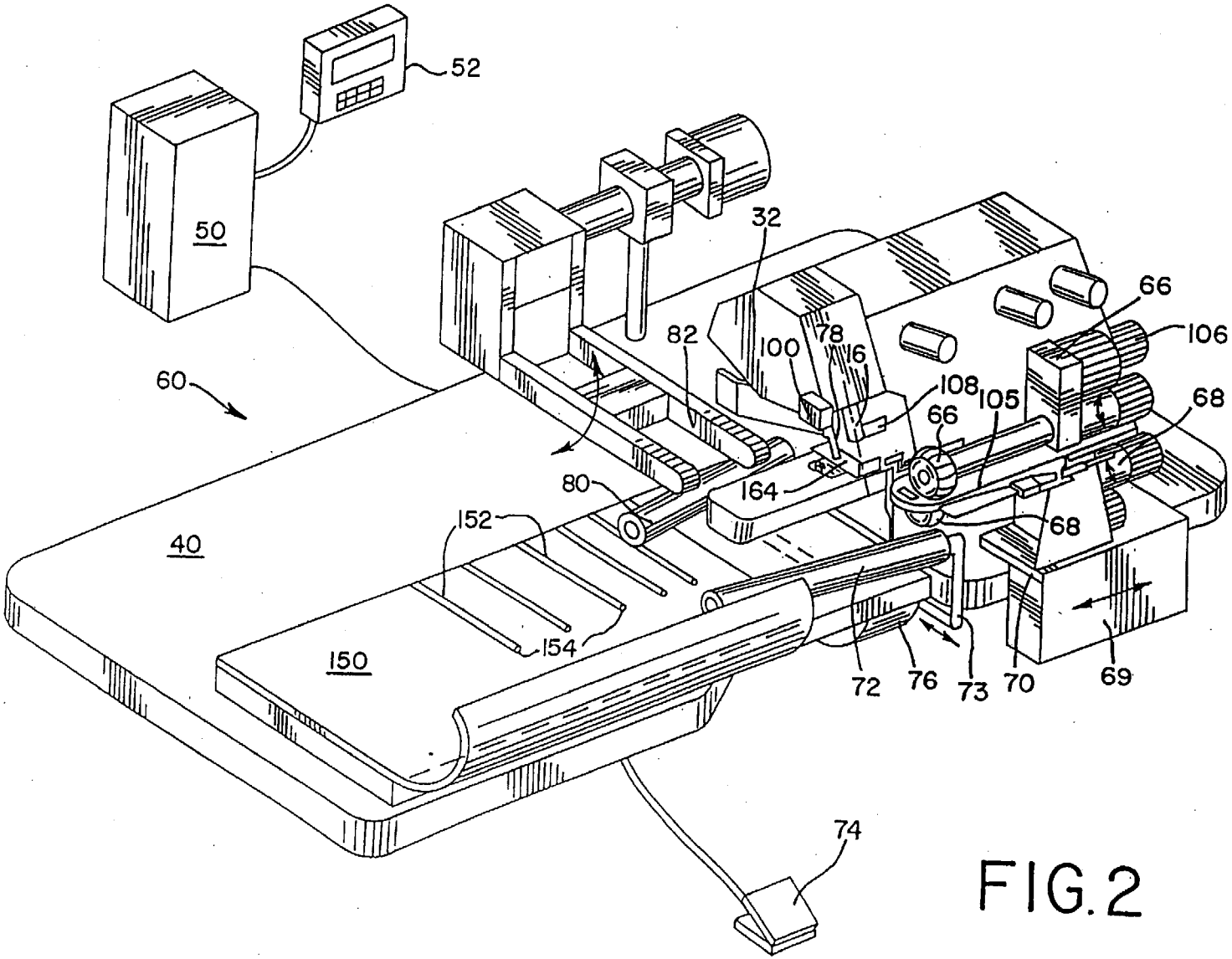
FIG. 2 is a perspective view of the sewing machine and material loading mechanism of this invention.

Referring now to FIG. 2 the sewing machine 32 and work piece control and advancing mechanism 60 will be described. The sewing machine 32 is a conventional cylinder bed overedge type machine such as the Union Special Model SP161 machine and includes a needle 16 and a presser foot 164. The sewing machine 32 is driven by a sew motor 76 that can be actuated by a foot switch 74. When the sewing machine 32 is running, the shaft encoder 106 (see FIG. 1) sends pulses or signals to the microprocessor controller 50. Shaft encoder 106 sends a series of pulse for every rotation of the sewing machine motor, which is equal to one stitch being produced by the sewing machine. The microprocessor controller 50 then feeds the proper pulses to the edge guiders to keep them in feed or speed synchronization with the sewing speed or feed rate. Thus, regardless of changes in sewing speed, which can occur as a result of acceleration or deceleration of the sewing motor, the feeding guiders properly track the workpieces. This important feature of applicants invention eliminates over or under tensioning which could cause improper guiding and open seams, puckering or distortion in the seam or improper finished garment size.

The sewing machine 32 and the work piece control and advancing mechanism 60 are mounted on a frame 40. The workpiece control and advancing mechanism 60 includes an upper edge guider 66 and lower edge guider 68 engage opposite sides of a double sided ply separator plate 143 that is located forward of the stitch forming instruments. The upper edge guider 66, lower edge guider 68 and ply separator plate 143 are all mounted on an edge guider slide 69 which enables this assembly to slide into and out of the stitch forming line.

The work piece control and advancing mechanism 60 also includes a front tensioning roller 72, that rotates freely and is mounted on frame 40 forward of the edge guiders 66 and 68. Front tensioning roller 72 can be moved linearly in a fore and aft direction in response to the actuation of front tensioning roller cylinder 73. A stationary rear roller 80 is mounted rearwardly of the stitch forming instruments. The rollers 72 and 80 converge such that their free ends are closer together then their mounted ends. The converging free ends not only facilitate loading of the work pieces but also complement the downward taper of the sleeves from their arm hole ends. When front tensioning roller is retracted to its load position, it has moved closer to the rear roller 80 making it easier to load the sleeve 200. As a result of the non-parallel arrangement of the rollers 72 and 80 when in the sew position, there is a tendency for the work product to creep toward the free ends of the rollers 72 and 80 as it is fed around the rollers. Front tensioning roller 72 is mounted such that it can be shifted to the right, at a predetermined programmable stitch count, during the sewing cycle to compensate for the products tendency to creep to the left. In addition to compensating for the tendency to creep, shifting the roller to the right also accommodates for the taper of the sleeve and for the tilt of the elliptically shaped arm hole end.

A chain cutter 78 is provided to sever the chain that attaches a finished work product to the sewing operation.

A side feed puller 82 having a pair of track type pullers is pivoted on the frame 40 at its end that is most remote from the stitch forming instruments. The free end of the side feed puller 82 overlies the rear roller 80 and functions to pull the work piece through the machine when lowered into contact with the work piece that is wrapped around rear roller 80.

As best seen in FIG. 2 a support plate 150 having a flat upper surface that merges into a semi-cylindrical extension of the flat upper surface is supported on the frame 40 at a location to underlay the bulky end of a shirt being sewn. There are a series of air blowers 152 on its top surface of support plate 150. The air blowers 152 are disclosed as tubes connected to the top surface of support plate 150 and have open discharge ends 154 through which air under pressure is discharged. The air blowers 152 are turned on at the same time that the uncurling blowers 105 are activated. The air streams flow along the top surface of the support plate and up the cylindrical surface. The air streams flow in the direction that the bottom rung of shirt body 300 is moving during the sewing operation. The air streams suspend the shirt body 300 over the surface of the support plate and assists in feeding the bulky mass of the bottom of the shirt during the sewing operation. This air stream assist prevents the shirt bottom from twisting about itself and creating a resistance to the operation of the edge guiders which would cause an open or irregular seams. The same results could be accomplished by mechanical devices such as mechanical rotary clamps or upper and lower opposing drive belts.

The shirt body 300 and sleeve 200 are presented to the operator as shown in FIG. 1. The cycle is initiated by the operator selecting "Automatic Mode" from the microprocessor 50 control panel. This prepares the machine for loading by extending the edge guiders 66 and 68 into the sew path, raises the side feed puller 82 and retracts the front tensioning roller 72. The presser foot 164 is in the lowered or down position. In accordance with the preferred embodiment for loading the shirt body 300 and sleeve 200, the operator picks up a sleeve 200, turns it right side out and loads it over the front tensioning roller 72 and rear roller 80. In loading the sleeve 200 the operator orients the arm hole alignment point 202 to the needle. As the sleeve 200 is being loaded, the operator actuates a treadle by moving her or his heel back which causes the presser foot 164 to be raised allowing the material to be located under the presser foot. When the operator has located the arm hole alignment point 202 under the presser foot the pressure on the heel treadle is released which causes the presser foot to lower and hold the work pieces under the presser foot. The material presence sensor 100 is covered in this process which sends a signal to the microprocessor 50 which causes the roller cylinder 73 to partially extend which in turn causes the front tensioning roller 72 to extend and stretch the sleeve 200. The edge of the arm hole end 204 is located by the operator on the bottom surface of the double sided ply separator plate 143 where it will be engaged by the lower edge guider 68. The shirt body 300 is then loaded, wrong side out, over the sleeve 200 and its arm hole alignment point 304 is orientated with the sleeve's arm hole alignment point 202. The aligned alignment points 202 and 304 are held under the presser foot 164 and the edge of the arm hole 302 is placed on the upper surface of the double sided ply separator plate 143. At this point the shirt body 300 and sleeve 200 are loaded and the operator holds the plies apart and initiates the automatic sewing operation by engaging the foot switch 74. When the foot switch 74 is engaged the edge guiders 66 and 68 move into the sew area and the side feed puller 82 comes down. After a short delay sewing begins.

A second embodiment for loading the shirt body 300 and sleeve 200 on the work piece control and advancing mechanism 60 follows. The operator slips several of the wrong side out sleeves 200 onto her or his right arm. Then the operator with her or his left hand, picks up the shirt body 300 at the shoulder point 306 and body arm hole alignment point 304. A sleeve 200 is then slipped over the shirt body 300, hem end 206 first. It should be noted that the sleeve 200 does not have to be turned right side out as in the manual method. The operator grasps both the body arm hole alignment point 304 and the arm hole alignment point 202 and loads them over the front tensioning roller 72 and rear roller 80 and then moves the body arm hole alignment point 304 and the arm hole alignment point 202 toward the lowered presser foot 164. The operator then actuates a treadle by moving her or his heel back which causes the presser foot 164 to be raised allowing the material to be located under the presser foot. The operator then releases the heel treadle which causes the presser foot to lower and hold the work pieces under the presser foot. The two plies of material are then loaded into the dual ply edge guiders 66 and 68 on opposite sides of the two sided ply separator plate 143.

After the shirt body 300 and a sleeve 200 are loaded the operator activates foot switch 74 that starts an automatic sewing cycle and chain cutting operation. The automatic sewing cycle and chain cutting operation is a hands off operation and does not require the assistance or attention of the operator. When the automatic sewing cycle and chain cutting operation is completed the operator manually removes the sewn product and the process is repeated for the other armhole 302 and another sleeve 200.

In addition to guiding the workpiece edges the microprocessor controller 50 monitors the edge guider sensors 9 and 10 to determine if the edges of the arm hole end 204 and arm hole 302 are being controlled. If there are no transitions in signal levels within a certain number of stitch counts during the sewing cycle, the microprocessor controller 50 will stop the operation and send a signal to the operator to identify and resolve any problem. The microprocessor controller 50 will resume the operation after the edge sensors are again transmitting signals at the proper level. This is a very important to the proper operation of this invention since it provided a means to prevent open seams in the garments. In the garment manufacturing industry an open seam is considered the most dreaded product defect.

The upper edge guider 66, shown in FIG. 6, and lower edge guider 68 are functionally identical and thus only the upper edge guider 66 will be discussed in detail. It should be noted that the edge guiding devices used in this application are substantially the same as those disclosed in the above identified U.S. Pat. Nos. 5,251,557, 4,512,268, 4,479,447 and U.S. application Ser. No. 08/123,000 and reference may be had to those patents for a more complete disclosure of the structural components of these devices.

Figure 6:
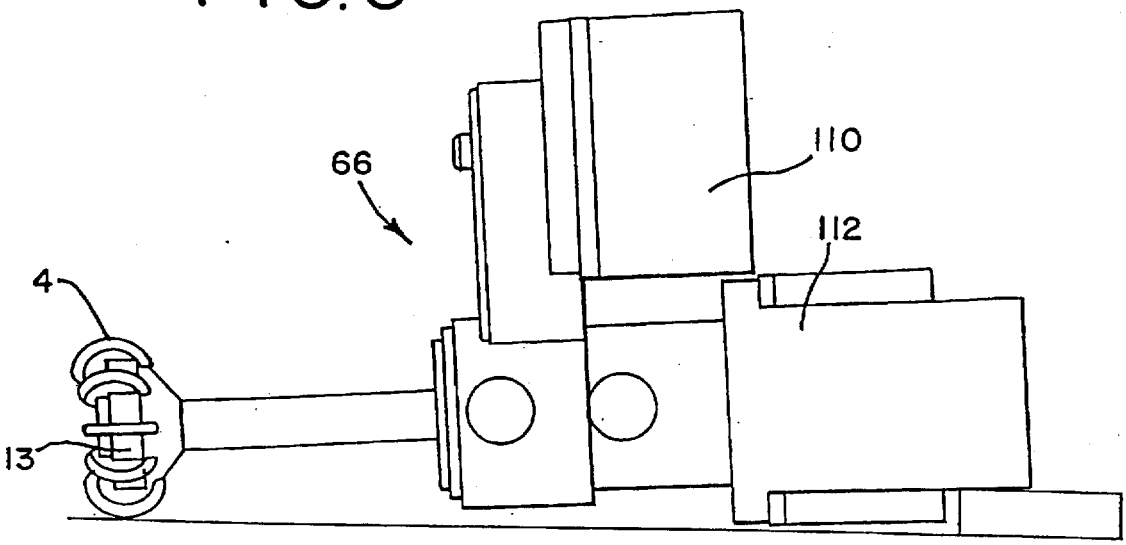
FIG. 6 is a side view of an edge guiding device of the type used in the automatic ply aligning and positioning mechanism of this invention.

Referring now to FIG. 6, the upper edge guider 66 has a first stepper motor 110 for driving the feeding wheel 13 that functions to advance the ply of material in the material feed direction and a second stepper motor 112 for driving the gripper wheels 4 that function to move the ply of material normal to the material feed direction. The stepper motors 110 and 112, can be controlled to rotate a specific number of rotations or fraction of a rotation. Thus, depending upon the diameter of the drive element and the drive ratios, a ply of material can be advanced a specific distance upon transmitting an actuation instructions to the stepper motor to run a specific number of steps.

The entire upper edge guider 66 is supported at one end on a horizontal pivot shaft 114. The other end, which is the material engaging head of the device, rest on the ply separator plate 143. The material engaging head can be lifted off the ply separator plate 143 by pivoting the entire device about horizontal pivot shaft 114. The top edge guider 66 can rely upon gravity or can include a mechanical device, such as a spring or an air cylinder, to assist in forcing the material engaging head into contact with the ply separator plate 143. The lower edge guider 68 must include a mechanical device, such as a spring or air cylinder, to bias its material engaging head into contact with its ply separator plate 143. The upper edge guider 66, lower edge guider 68 and ply separator plate 143 are mounted on an edge guider slide 69 (see FIG. 2) such that they can be automatically moved horizontally, to shift them between operative and inoperative locations.

Figure 7:
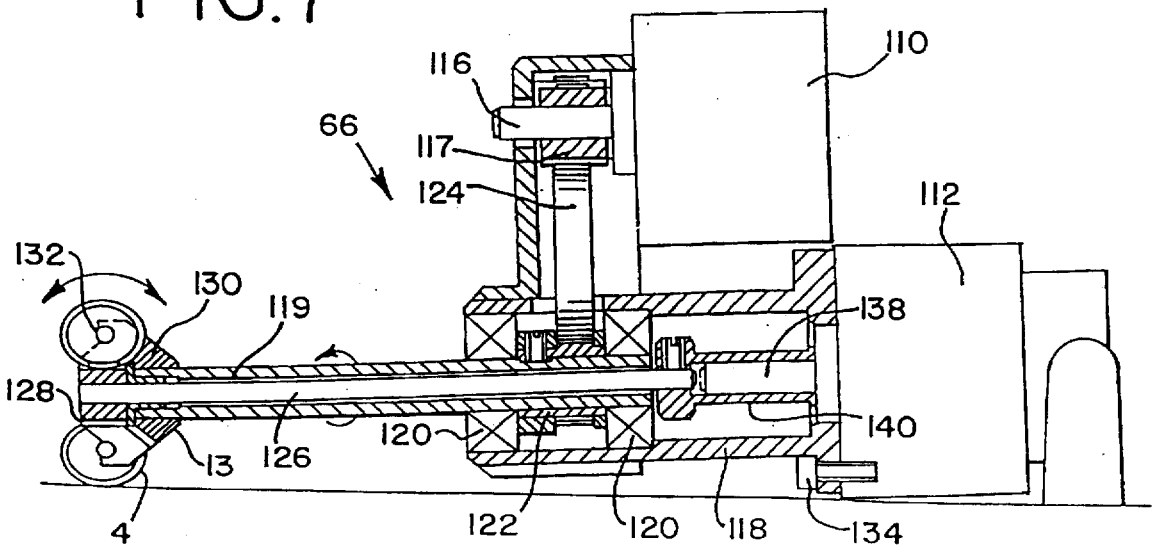
FIG. 7 is a cross section view of the edge guiding device seen in FIG. 6.

FIG. 7 is a cross section view of the top edge guider 66 seen in FIG. 6. A housing 118 has the first stepper motor 110 mounted to its outer surface. First stepper motor 110 has an output shaft 116 with a pinion 117 secured thereto. A hollow shaft 119 is mounted for rotation by bearings 120 in the housing 118 and has a pinion 122 secured thereto. Pinion 122 is mechanically connected by way of a toothed belt 124 to pinion 117. Rotary drive is transmitted from stepper motor 110 through toothed belt 124 to the hollow shaft 119. A feeding wheel 13 is fixed to the free end of hollow shaft 119 and thus rotates therewith. The feeding wheel 13 has a plurality of openings 130 formed therein in which gripper wheels 4 are mounted for rotation on shafts 132. The peripheral edges of gripper wheels 4 are in driving engagement with worm gear 128 and are caused to rotate thereby. Worm gear 128 is secured to the free end of shaft 126 that is mounted for rotation within the hollow shaft 119.

The housing 118 is secured to one end of second stepper motor 112 by bolts 134. The other end of second stepper motor 112 is pivotally mounted to the base 104 of the sewing machine 32 about a pivot shaft 114. The output shaft 138 of second stepper motor 112 is secured to shaft 126 by a coupler 140. The feeding wheel 13 of top edge guider 66 can be lifted off ply separator plate 143 by pivoting the edge guider 62 upwardly about shaft 114.

Figure 8:
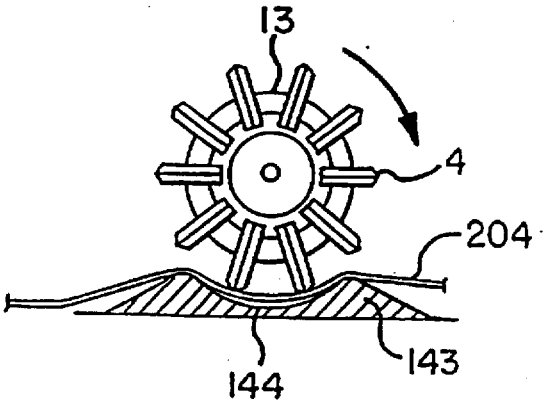
FIG. 8 is an end view of the feeding and gripper wheel head of the edge guiding device seen in FIG. 6.

FIG. 8 which is an end view of the feeding wheel 13 includes a ply of material designated 204, which is the arm hole end of the sleeve 200. The arm hole end 204 is located between the peripheral edge of feeding wheel 13 and the ply separator plate 143. Ply separator plate 143 has a cylindrical shaped concave surface 144 that cooperates with the peripheral edges of gripper wheels 4 to grip the material 142 so as to feed it in the precise amount intended. As a result of the concave shape of surface 144 a plurality of gripper wheels 4 can be in engagement with the sleeve material 204 at the same time which enhance the control and precision of this feed.

The sensors used with the edge guiders of this invention are of the retro-reflective type in which emitted rays are reflected back to the sensor. The emitted rays are directed at a highly reflective surface, or a surface to which reflective tape has been applied. When the ply of material moves into the area where the rays are directed there is a change in the rays that are reflected back to the sensor. This change is detected by the sensor and the change is transmitted to the control system.

Diffuse type sensors could also be used. Diffuse type sensors recognize characteristics of a particular type of surface that they are intended to sense and do not require the presence of a highly reflective surface.

It is important to the operation of this invention that the sensors for all edge guiders be directionally coordinated such that they all attempt to guide the material edge that they are monitoring the same distance from the line of stitching. If the aim of one sensor is off, in the direction that will cause the marginal edge of the material to be spaced from the stitch line a greater distance than for the other layers of fabric, then a wide ribbon of excess waste material will be trimmed from the one layer. This is unacceptable because of the material that is wasted. However, if the aim of one sensor is off in the other direction, such that the material edge being monitored by this sensor is missed by the line of stitches then the seam is defective and the completed piece must be rejected.

Figure 9:
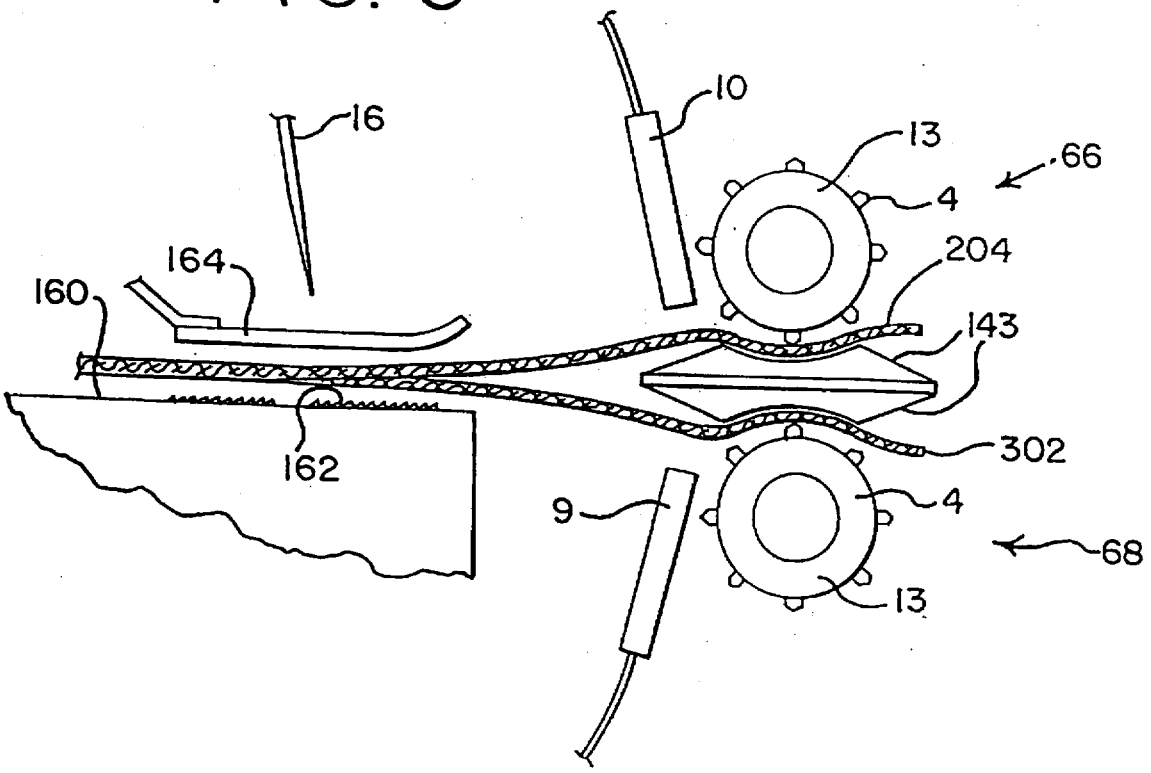
FIG. 9 is a diagrammatic end view illustration of the material loading and stitch forming areas of the sewing machine seen in FIG. 2.

FIG. 9, which is a diagrammatic end view illustration of the material loading and stitch forming areas of the sewing machine seen in FIG. 2, discloses the feeding wheels 13 and gripper wheels for both the upper edge gripper 66 and the lower edge gripper 68 in engagement with the material of the sleeve 200 and shirt body 300 respectfully. The two sided ply separator plate 143, upper edge sensor 10 and lower edge sensor 9 are also shown in this view. The material 204 and 302 is shown between the raised presser foot 164 and throat plate 160. The needle 16 and the upper portions of the feed dog 162 is also visible in this view. When the upper and lower edge sensors 10 and 9 are not covered by the material 204 and 302 the gripper wheels 4 independently rotate in the direction to feed the material toward the point that their corresponding sensor is directed. When the material has been moved by the gripper wheels 4 in that direction sufficient to cover the area that their corresponding sensor is directed, then the rotation of wheels 4 is reversed and the material is feed in the opposite direction. This uncovers the sensor which results in reversing the direction of feed of the gripper wheels 4. Thus the gripper wheels 4 are continuously causing the sensors 9 and 10 to be covered and uncovered which in turn continuously reverse the direction of rotation of gripper wheels 4 and maintain the marginal edges of the material 204 and 302 in proper alignment with the needle 16.

Figure 3:
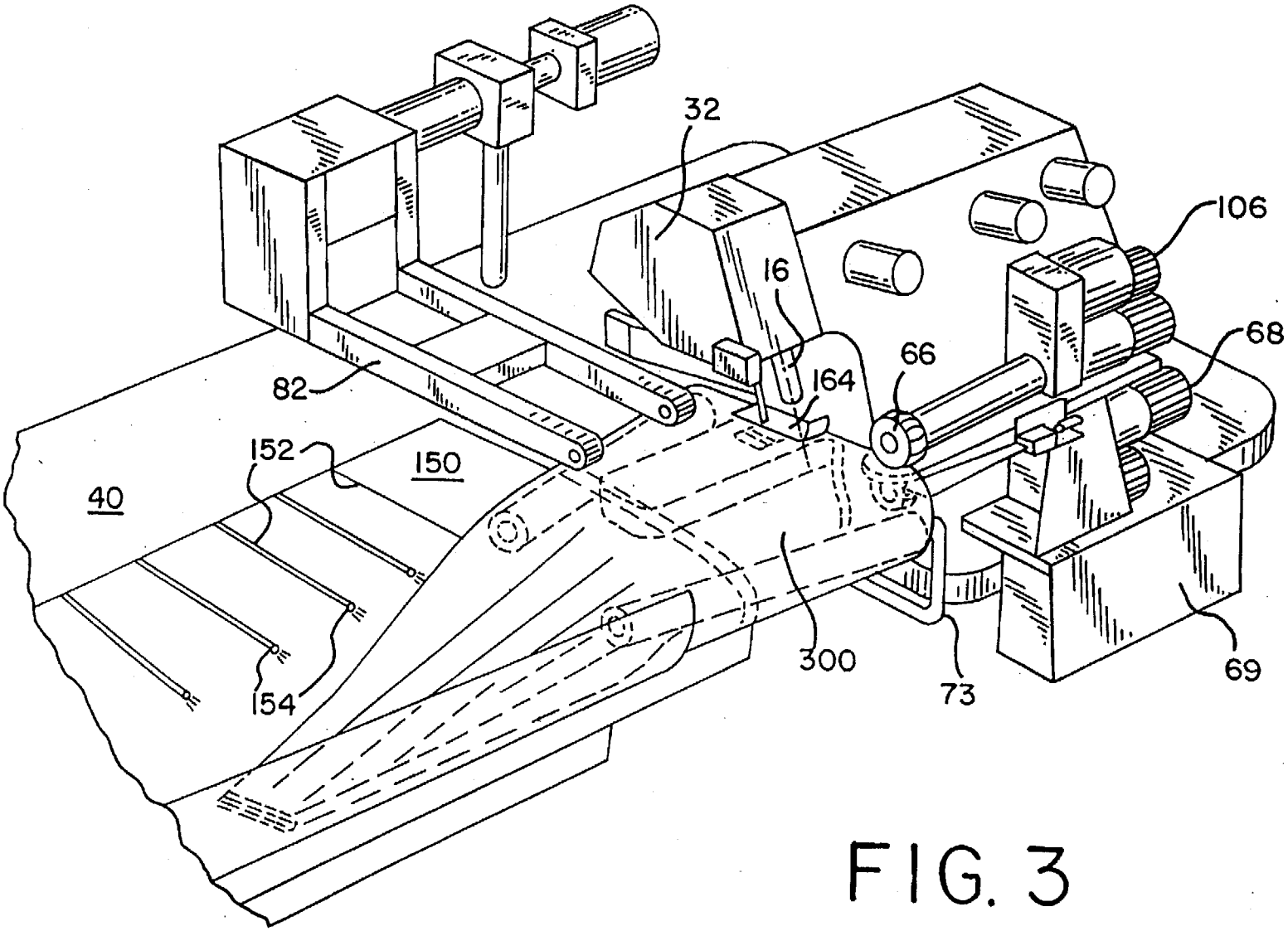
FIG. 3 is a perspective view of the sewing machine and material handling mechanism of this invention with the shirt body and sleeve loaded and ready to be sewn.

FIG. 3 is a perspective view of the sewing machine and material handling mechanism of this invention with the shirt body and sleeve loaded and ready to be sewn. At this point in the operation the gripper wheels 4 have aligned the edges of the sleeve arm hole 204 and the body arm hole 302 and the edge guiders 66 and 68 are in place. Also the side feed puller 82 has been lowered into engagement with the top surface of the shirt body 300. Both the shirt body 300 and the sleeve 200 are between the side feed puller 82 and the rear roller 80. When the operator actuates the start sewing switch the sewing operation is automatic and the operator's hands are free to prepare for the next loading operation. Support plate 150, its series of air blowers 152 and semi-cylindrical extension are seen in this view. The air blowers 152 create a moving air flow below the bulky end of a shirt that assist in the rotation of the bottom end on the shirt. The air streams flow in the direction that the bottom rung of shirt body 300 is moving during the sewing operation.

Figure 4:
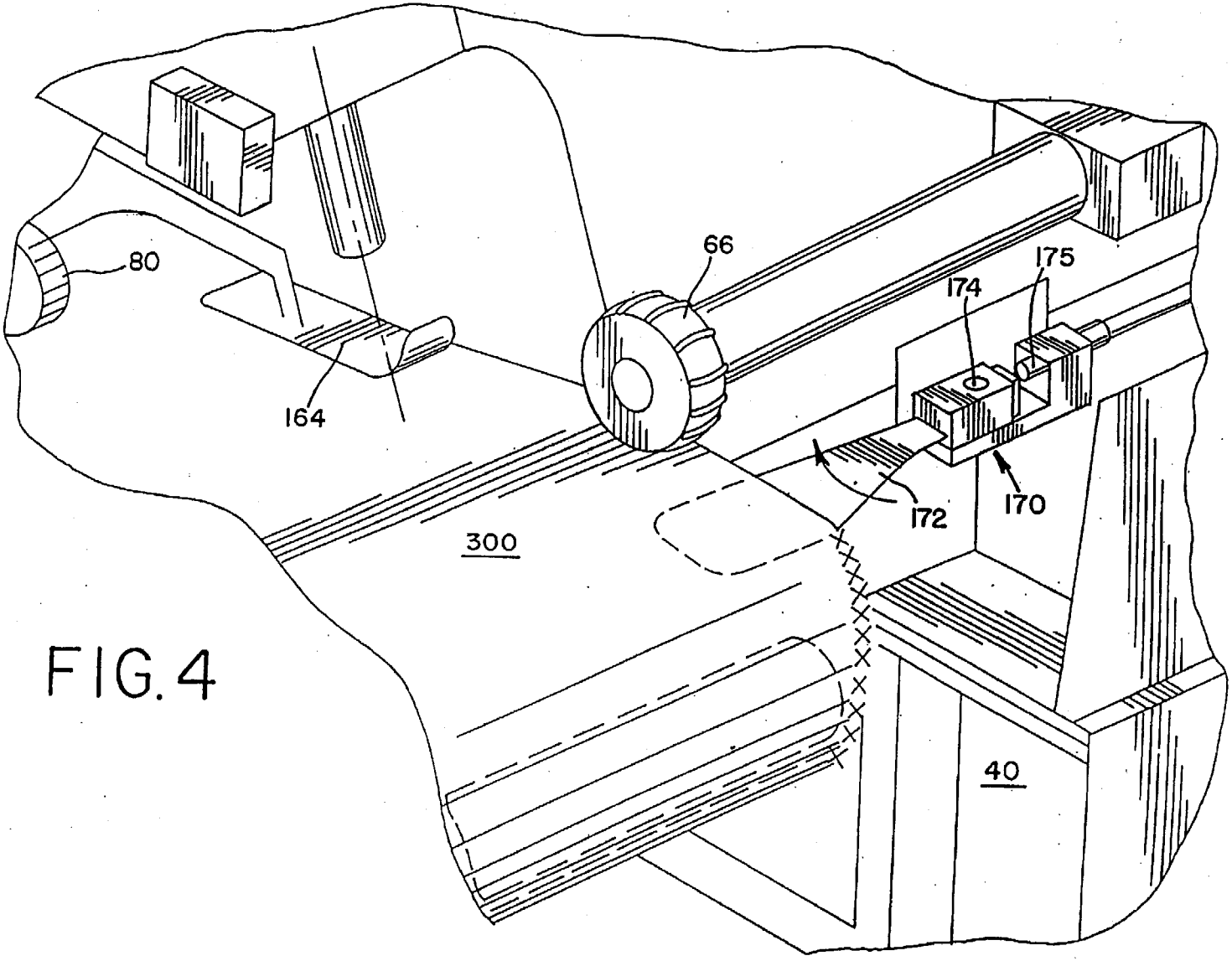
FIG. 4 is an enlarged perspective view of the seam detector mechanism and the surrounding sewing machine and material handling mechanism of this invention.

FIG. 4 is an enlarge perspective view of the seam detector mechanism 170 about to be engaged by the sewn seam. As seen in FIG. 4 the automatic sew cycle is in progress and the beginning of the seam is approaching the edge guider mechanisms 66 and 68. Since the plies 302 and 204 have been stitched together they can not be fed to both surfaces of the ply separator plate 143. The seam detector mechanism 170 thus must be located forward of the edge guiders 66 and 68 and ply separator plate 143. The seam detector mechanism 170 includes a seam detector lever 172 that is pivotally mounted about sensor pivot 174 on a proximity sensor 175. The seam detector lever 172 is constructed of a sheet material such as stainless steel that is horizontally arranged and is located such that the shirt body 300 passes over its upper surface and the sleeve 200 passes beneath its lower surface. As illustrated in FIG. 4, when the beginning of the sewn seam reaches the forward edge of the seam detector lever 172 it causes seam detector lever 172 to pivot to the rear about its sensor pivot 174. This rearward pivoting of the seam detector lever 172 activates the proximity sensor 175 which sends a signal to the microprocessor controller 50 which in turn sends a signal to actuate the edge guider slide 69. When the edge guider slide 69 is actuated it causes the upper 66 and lower 68 edge guiders along with the ply separator plate 143 to be retracted back out of the stitch formation line. Actuation of the proximity sensor 175 also initiates the operation a stitch counter which will cause stitching to stop after a specific number of stitches have been completed.

Figure 5:
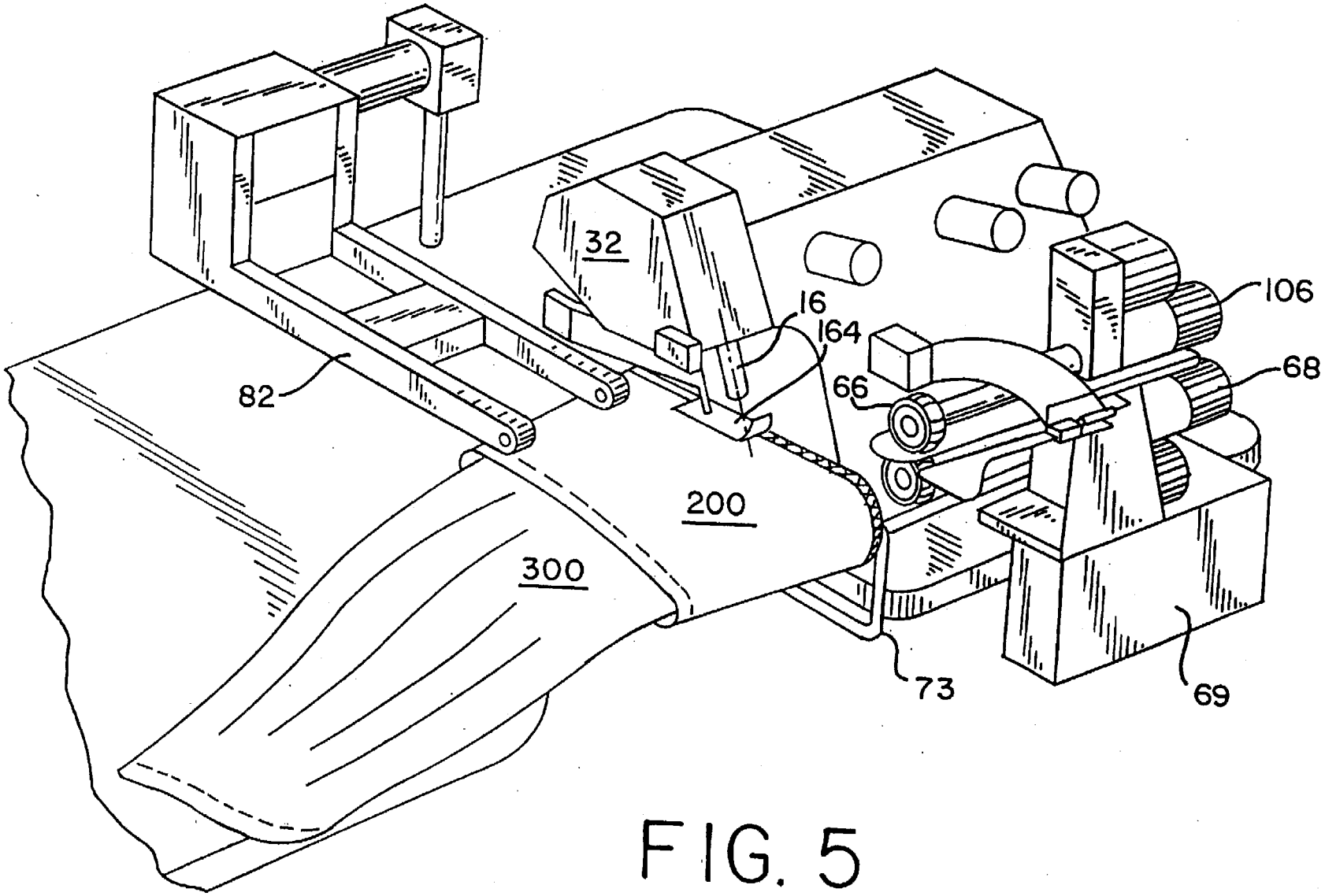
FIG. 5 is a perspective view of the sewing machine and material handling mechanism of this invention with the shirt body and sleeve loaded and approaching the end of the sewing cycle.

FIG. 5 is a perspective view of the sewing machine 32 and material handling mechanism 60 of this invention with the shirt body 300 and sleeve 200 loaded and approaching the end of the sewing cycle. This Figure shows the mechanism as they are located immediately after the seam detector 170 was actuated and the upper edge guider 66 and lower edge guider 68 along with the ply separator plate 143 have been retracted out of the line of stitch. The feeding and guiding function of the edges guiders 66 and 68 is stopped as is the sewing operation. After a short delay the edge guiders 66 and 68 are returned to the sew area and sewing is resumed. At this time both sewn plies 302 and 204 are under the upper edge guider 66. After a predetermined delay the upper edge guider 66 ejects the material edge to the left of the needle 16 while the sewing machine continues to operate producing a stitch chain that is connected to the sewn garment. An air cylinder 108 (see FIG. 2) is mounted to the right and in the front of the needle 16 that has a hook or finger that moves along the work surface in a direction normal to the direction of feed of the garment. Air cylinder 108, which is activated independently of the upper edge guider 66, prevents the garment from returning to the sew area. The hook or finger engages the marginal edge of the garment to insure that it does not return to the sew area. The stitch chain that is attached to the garment must be severed to remove the sewn garment from the sewing machine 32. After a predetermined delay the chain is sucked into the inlet of the chain cutter 78 and the chain is severed. After another delay, sewing is stopped, the presser foot 164 is raised and the garment can be removed by the operator. The operator then repeats the same sequence for the other arm hole.

Figure 10:
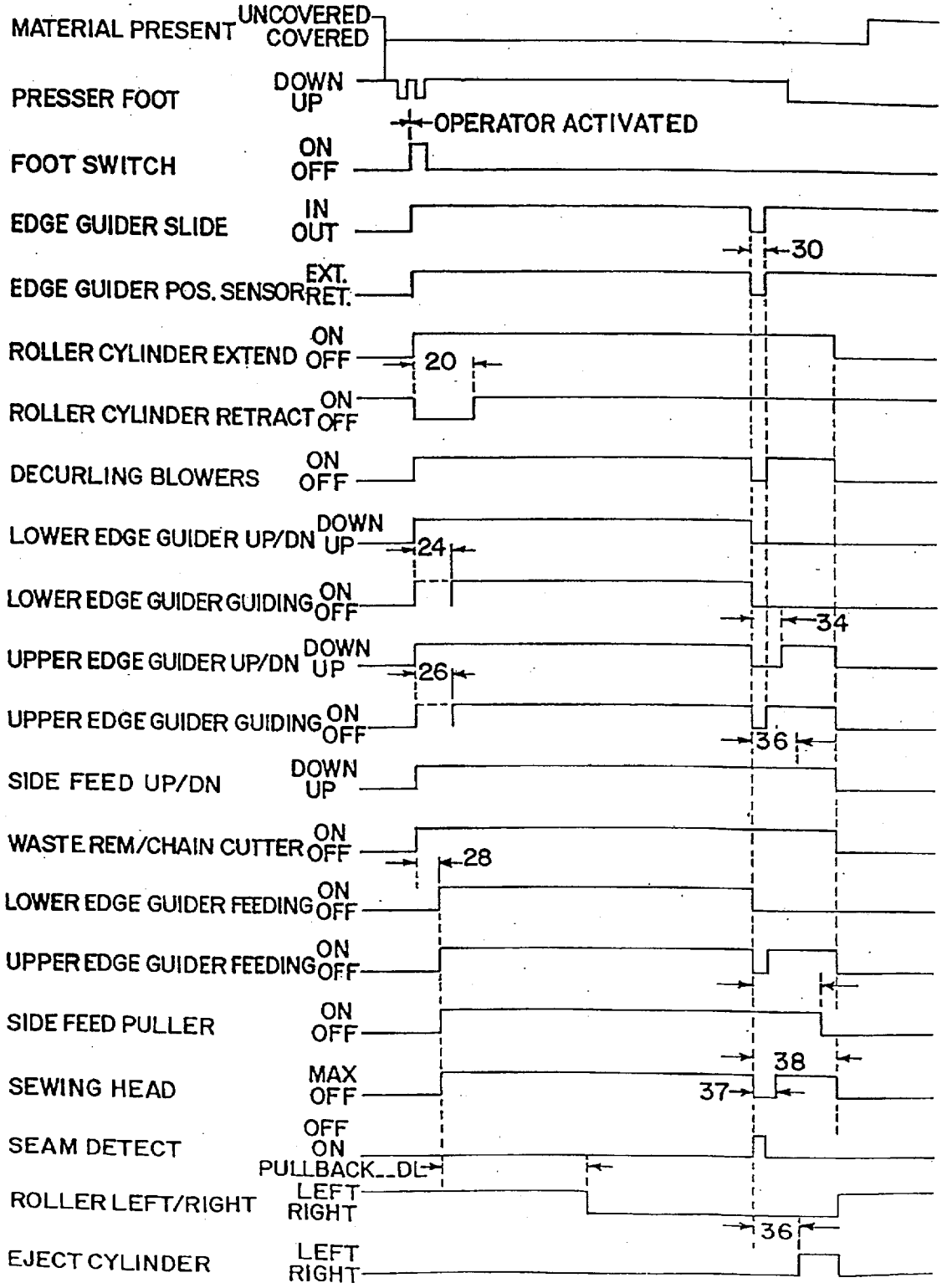

FIG. 10 is a timing diagram for the preferred embodiment of the automatic set sleeve sewing cycle. In this diagram various sensors and machine components such as the edge guide position sensor 70 and the presser foot 164 are identified in a column on the left. Each sensor or machine components is followed by an either-or-statement such as uncovered\covered, down\up, on\off, in\out or extend\retract. To the right of the either-or-statement is the corresponding timing line for the sensor or machine component showing when in the cycle the sensor or machine component is down or up, or on or off. Various periods, defined in either milliseconds or in number of stitches, are identified by reference numerals and discussed herein. These periods can be changed or adjusted by an entry in the microprocessor through its control panel.

Prior to initiating the automatic sewing cycle the operator selects "Automatic Mode" from the control panel of the microprocessor. This selection prepares the machine for loading the shirt body 300 and sleeve 200. The side feed puller 82 is raised and the front tensioning roller 72 is retracted to its load position.

The operator then proceeds to loads the sleeve 200 under the presser foot 164 and under the edge guider 68. The material presence sensor 100 is covered in this process which sends a signal to the microprocessor 50 which causes the roller cylinder 73 to partially extend which in turn causes the front tensioning roller 72 to extend and stretch the sleeve 200. As the sleeve 200 is being moved toward the lowered presser foot the operator actuates a treadle by moving her or his heel back which causes the presser foot 164 to raise allowing the sleeve 200 to be located under the raised presser foot. The operator then releases the back pressure on the treadle which permits the presser foot to lower and to hold the plies of material in the loaded position. The operator then loads the sleeve arm hole edge 204 on the lower surface of the ply separator plate 143. This process is then repeated for loading the shirt body 300.

The operator then engages the foot switch 74 which starts the automatic sewing operation. Actuation of foot switch 74 causes the edge guider slide 69 that carries the upper edge guider 66 and the lower edge guider 68 to be shifted into the sew area. Actuation of the foot switch 74 also initiates the extension of roller cylinder 73 which will cause front tensioning roller 72 to pivot about its vertical pivot axis from its load position to its sew position and to stretch the work pieces that are mounted over rollers 72 and 80. Reference number 20 indicates the number of encoder counts that it will take for the front tensioning roller 72 to reach its sew position.

The uncurling blowers 105 and the air blowers 152 are turned on in response to the actuation of the foot switch 74. Also, in response to the actuation of the foot switch 74 the upper edge guider 66 and lower edge guider 68 are moved to their down position at which they engage the material plies on the opposite surfaces of the ply separator plate 143. Although the operative end of the lower edge guider 68 actually moves up rather than down to reach its down position its position at which the material ply is pressed between it and the lower surface of the ply separator plate 143 is herein referred to as its down position. The edge guiders 66 and 68 do not necessarily begin their guiding function immediately after being moved to their down position. Reference number 24 represents the number of stitches after actuation of foot switch 74 that the lower edge guider 68 begins its guiding function. Likewise, reference number 26 represents the number of stitches after actuation of foot switch 74 that the upper edge guider 66 begins its guiding function. When reference numbers 24 and or 26 are equal to zero then the edge guiders 66 and or 68 begin their guiding function immediately after actuation of foot switch 74.

Upon actuation of foot switch 74 the side feed puller 82 moves to its down position at which the two plies of material are pressed between it and rear roller 80. Also, in response to the foot switch 74 being actuated the chain cutter 78 and the waste material removal mechanism are activated.

There is a time delay after actuation of foot switch 74 before upper 66 and lower 68 edge guiders start their feeding function. This time delay period is represented in FIG. 10 by reference number 28.

The front tensioning roller 72 is in its sew position when sewing is started. The work piece has a tendency to drift toward the left from the position where it was loaded on rollers 72 and 80. To counteract this, tensioning roller 72 is shifted to the right at a time about midway through the automatic sew cycle. In FIG. 10 reference number 30 represents the time period that the tensioning roller 72 remains in its initial sew position.

A seam detector 170 is activated by the finished seam when the finished seam is returning toward the edge guiders 66 and 68. Actuation of the seam detector 170 sends a signal to the microprocessor 50 which causes the edge guiders 66 and 68 to be raised away from the ply separator plate 143. Actuation of the seam detector 179 also actuates the edge guider slide 69 which moves the edge guiders 66 and 68 along with the double sided ply separator plate 143 out of the sew area. After a programmed time period the edge guiders 66 and 68 and the double sided ply separator plate 143 are returned to the sew area. In FIG. 10 the number of stitches that the edge guiders 66 and 68 are out of the sew area is indicated by reference number 30. The uncurling blowers 105 are also turned off during time period 30.

When the edge guiders 66 and 68 are returned to the sew area both plies of material, the shirt body 300 and the sleeve 200, are on the upper surface of the double sided ply separator plate 143 and their sewn edge is under the control of the upper edge guider 66. For this reason when the edge guiders 66 and 68 are returned to the sew area only upper edge guider 66 is lowered. The total time that upper edge guider 66 is up is indicated in FIG. 10 by reference number 34. Lower edge guider 68 remains in the raised position.

A time period is established that is measured in stitches after the seam is detected that will cause the upper edge guider 66 to force the material under its control out to the left. When the material is forced out from under the presser foot 164 the sewing head continues to operate and forms a chain. At the same time that upper edge guider 66 forces the garment out from under the presser foot 164 the air cylinder 108 is activated which causes hook or finger 109 to move laterally of the direction of material feed, engage the marginal edge of the garment to assist and insure its ejection from the sew area. This time period is identified in FIG. 10 by reference number 36.

When the seam detector 170 is activated the sewing head is immediately stopped for a period indicated by reference numeral 37. Also at this moment a time period is established for stopping the automatic sewing cycle. This time period is identified in FIG. 10 by reference number 38.

All of the parameters such as speeds, delay periods, time periods, stitch counts and encoder pulse numbers that go into the timing diagram can be changed and are programmable through the microprocessor control panel. This is a very important feature of this machine since it allows the machine to be used for all sizes and numerous styles of apparel.

Figure 11:
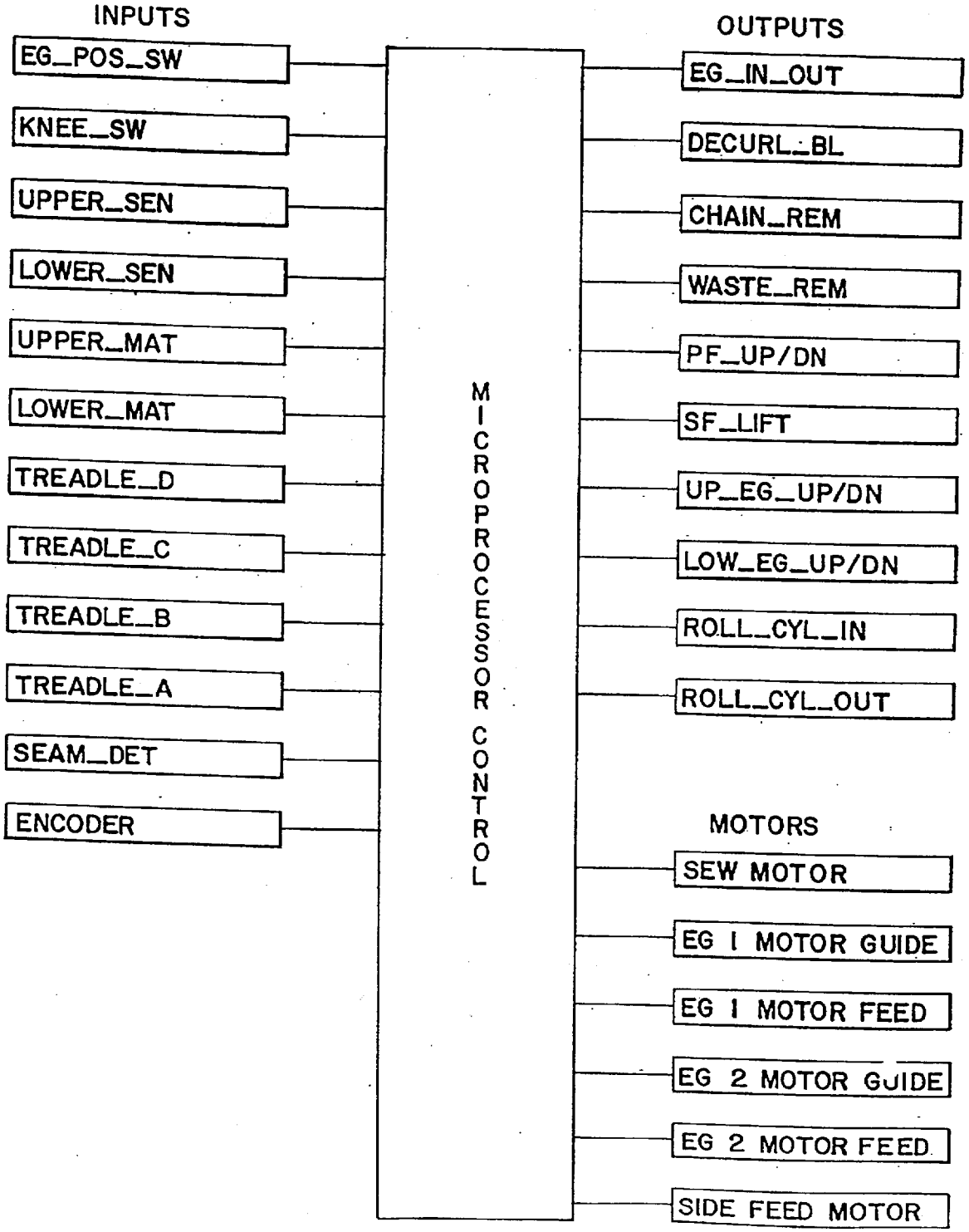
FIG. 11 is a block diagram of the systems microprocessor controller and electronic controls.

FIG. 11 is a block diagram that includes the systems microprocessor controller 50, the components that it controls including the stepper motors and the solenoids and the inputs to the controller 50.

While the invention has heretofore been described in detail with particular reference to illustrated apparatus, it is to be understood that variations, modifications and the use of equivalent mechanisms can be effected without departing from the scope of this invention. It is, therefore, intended that such changes and modifications be covered by the following claims.

What is claimed is:

1. A method for loading a right side out shirt body work piece having an arm hole formed about an edge and a sleeve work piece having a hemmed end and an arm hole end formed about an edge on the work piece control and advancing mechanism of a sewing machine that including a presser foot, in which the work piece control and advancing mechanism includes a set of rollers and edge guiders, said shirt body armhole and sleeve arm hole each having an alignment point, comprising the steps of:

(a). picking up a wrong side out sleeve with one hand;

(b). picking up the right side out shirt body with the other hand at the arm hole;

(c). sliding the wrong side out sleeve, hemmed end first, over the shirt body until the edge of the sleeve arm hole is aligned with the edge of a shirt arm hole;

(d). aligning the alignment points of the shirt body arm hole edge and the sleeve hole edge;

(e). loading the work pieces over the set of rollers with the aligned edges first;

(f). raising the presser foot;

(g). placing the aligned alignment points under the raised presser foot;

(h). lowering the presser foot; and (i). loading the shirt body sleeve hole edge and the sleeve hole edge into individual edge guiders.

2. A method for loading a shirt body having an arm hole formed about an edge and a sleeve having an arm hole end formed about an edge on the work piece control and advancing mechanism of a sewing machine that includes a presser foot, and in which the work piece control and advancing mechanism includes a set of rollers, edge guiders, and sensors, said shirt body armhole and sleeve arm hole each having an alignment point, comprising the steps of:

(a). picking up a wrong side out sleeve;

(b). turning the wrong side out sleeve right side out;

(c). loading the right side out sleeve over the set of rollers with said sleeve arm hole end first;

(d). extending one of the rollers to stretch the sleeve arm hole;

(e). loading the wrong side out shirt body over the set of rollers through an arm hole;

(f). aligning the alignment points of the shirt body sleeve hole edge and the sleeve hole edge;

(g). placing the aligned alignment points under the raised presser foot;

(h). lowering the presser foot; and (i). loading the shirt body sleeve hole edge and the sleeve hole edge into individual edge guiders.

3. A method of setting a first and a second sleeve, each having an arm hole end, into a shirt body having arm holes on a sewing machine having a presser foot in combination with a work piece control and advancing mechanism and a microprocessor, said shirt body arm holes and sleeve arm holes each having an alignment point, comprising the steps of:

(a). loading a first sleeve and a shirt body on the work piece control and advancing mechanism;

(b) aligning the alignment points of the shirt body and said first sleeve;

(c). raising the presser foot;

(d). placing the aligned alignment points under the raised presser foot;

(h). lowering the presser foot;

(i). actuating an automatic sew cycle for sewing said first sleeve to the shirt body;

(j). preparing to load the second sleeve during the automatic sew cycle;

(k). loading said second sleeve and said shirt body on the work piece control and advancing mechanism;

(b) aligning the alignment points of the shirt body and the second sleeve;

(c). raising the presser foot;

(d). placing the aligned alignment points under the raised presser foot;

(h). lowering the presser foot;

(i). actuating an automatic sew cycle for sewing the second sleeve to the shirt body.

4. A method for loading a shirt body having an arm hole formed about an edge and a sleeve having an armhole formed about an edge on a work piece control and advancing mechanism of a sewing machine that includes a raised presser foot, and in which the work piece control and advancing mechanism includes a set of rollers and edge guider mechanism, comprising the steps of:

(a). picking up a sleeve with one hand;

(b). picking up the shirt body with the other hand at the arm hole;

(c). sliding the sleeve over the shirt body and aligning the arm hole edges;

(d). loading the work pieces over the set of rollers with the aligned arm hole edges first;

(g). placing the work pieces to be sewn under the raised presser foot;

(h). lowering the presser foot; and (i). loading the work pieces to be sewn into individual edge guiders.

5. A method for loading a wrong side out shirt body work piece having sleeve holes formed about edges and a sleeve work piece having an armhole formed about an edge on a work piece control and advancing mechanism of a sewing machine that includes a raised presser foot, and in which the work piece control and advancing mechanism includes a set of rollers, edge guider mechanism, and sensors, said shirt body sleeve holes and sleeve arm holes each having an alignment point, comprising the steps of:

(a). picking up a sleeve;

(b). loading the sleeve over the set of rollers;

(c). extending one of the rollers to stretch the sleeve arm hole;

(d). loading the wrong side out shirt body over the set of rollers through an arm hole thereof;

(e). aligning the alignment points of the shirt body sleeve hole edge and the sleeve hole edge;

(f). placing the aligned alignment points under said raised presser foot;

(g). lowering the presser foot; and (h). loading the shirt body sleeve hole edge and the sleeve hole edge into individual edge guiders.

* * * * *